US009051796B2

(12) United States Patent
McCoy et al.

(10) Patent No.: US 9,051,796 B2
(45) Date of Patent: Jun. 9, 2015

(54) METHOD AND APPARATUS FOR REMOVING SHIFTING TOOLS AND PROVIDING WELLBORE ISOLATION

(75) Inventors: Matthew T. McCoy, Richmond, TX (US); Colin Patrick Andrew, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 761 days.

(21) Appl. No.: 13/274,425

(22) Filed: Oct. 17, 2011

(65) Prior Publication Data

US 2013/0092398 A1 Apr. 18, 2013

(51) Int. Cl.
*E21B 23/00* (2006.01)
*E21B 34/14* (2006.01)

(52) U.S. Cl.
CPC ..... *E21B 23/00* (2013.01); *E21B 34/14* (2013.01)

(58) Field of Classification Search
CPC ..... E21B 23/00; E21B 23/01; E21B 34/14
USPC ..... 166/214, 216, 217, 332.4, 381, 382, 166/215
See application file for complete search history.

(56) References Cited

U.S. PATENT DOCUMENTS 3,856,081 A * 12/1974 Canalizo ..... 166/123
4,043,392 A * 8/1977 Gazda ..... 166/217
7,712,538 B2 * 5/2010 Fay ..... 166/332.4

OTHER PUBLICATIONS

Schlumberger, [online]; [retrieved on Dec. 15, 2011]; retrieved from the Internet http://www.slb.com/completions, "Effective well control with unsurpassed reliability", Copyright 2009, 8pgs.

* cited by examiner

*Primary Examiner* — David Andrews
*Assistant Examiner* — Kristyn Hall
(74) *Attorney, Agent, or Firm* — Cantor Colburn LLP

(57) ABSTRACT

A system for performing a downhole operation including a tubular string having a locking profile non-movably located therewith. At least one member is movably mounted with the string and includes an engagement profile. A tool is runnable with the string and has at least one sub with a key. The key is selectively engagable and disengagable with the engagement profile for enabling the tool to control movement of the member with respect to the string when engaged therewith. The key is engagable with the locking profile for restricting relative movement between the string and the tool when engaged therewith. A method of performing a downhole operation is also included.

6 Claims, 3 Drawing Sheets

METHOD AND APPARATUS FOR REMOVING SHIFTING TOOLS AND PROVIDING WELLBORE ISOLATION

BACKGROUND

Shifting tools are ubiquitously used in the downhole drilling and completions industry, particularly to selectively open ports in various downhole operations. For example, in a fracturing operation sleeves may be shifted with a shifting tool on a service string for successively opening and fracturing through ports, then closed to force formation fluids, e.g., hydrocarbons, into the production string through sand screens or the like as opposed to the ports. Some of the ports may be unintentionally reopened by the shifting tool while pulling the service string out of the hole in this type of fracturing and sand control operation, adversely affecting production. The industry accordingly well receives advances to overcome the aforementioned and other disadvantages in current systems.

BRIEF DESCRIPTION

A system for performing a downhole operation, including a tubular string having a locking profile non-movably located therewith; at least one member movably mounted with the string and including an engagement profile; and a tool runnable with the string and having at least one sub with a key, the key selectively engagable and disengagable with the engagement profile for enabling the tool to control movement of the member with respect to the string when engaged therewith, the key engagable with the locking profile for restricting relative movement between the string and the tool when engaged therewith.

A method of performing a downhole operation including running in a tool with a string, the string having at least one member movably mounted with the string, the member having an engagement profile; engaging a key of the tool with the engagement profile of the member; moving the member with a service string connected to the tool; disengaging the key from the engagement profile; and engaging the key with a locking profile non-movably secured to the string for restricting relative movement of the tool with respect to the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
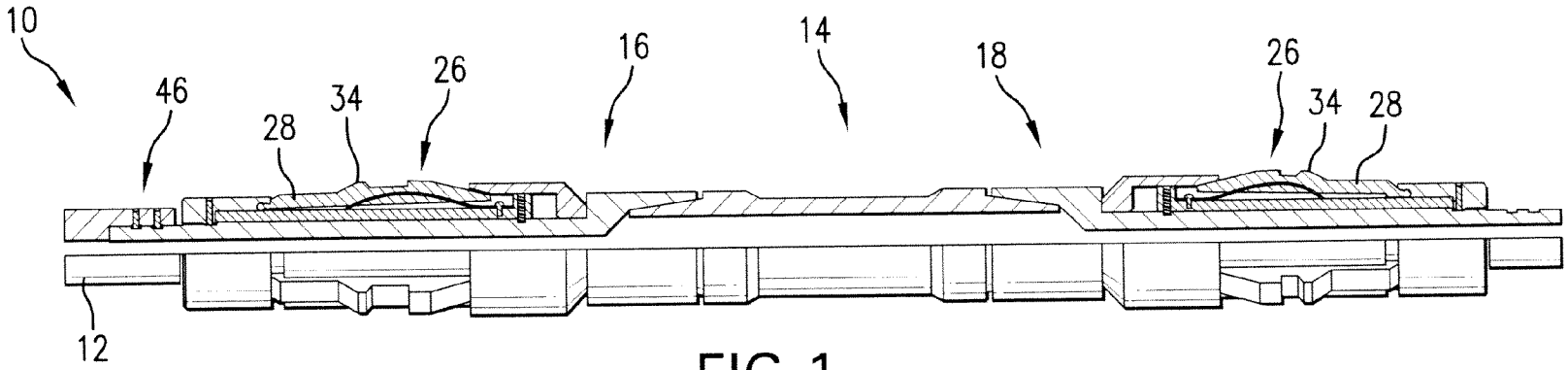
FIG. 1 is a three-quarter sectional view of a system including a shifting tool releasably connected to a service string.

Referring now to FIG. 1, an assembly 10 is shown. The assembly 10 includes a service string 12 coupled to a shifting tool 14. The service string 12 is, for example, controlled by operators at the surface of a borehole in which the string 12 is run. Regardless of structure, the string 12 and the tool 14 enable the operators or the like to perform operations downhole, such as selectively opening and closing ports by engaging with and shifting sleeves or actuating other members or tools housed in a tubular string. For simplicity of discussion, the term "sleeve" as used herein is intended to refer generally to any shiftable or actuatable member, tool, component, etc., and the terms "movable", "shiftable", "actuatable", etc. are thus interchangeable with respect thereto. Further, the shifting tool 14 is shown and described for illustrative purposes only and it is to be appreciated that other styles of shifting tools could be used, for example, including collet fingers, extendable members, etc.

Figure 2:
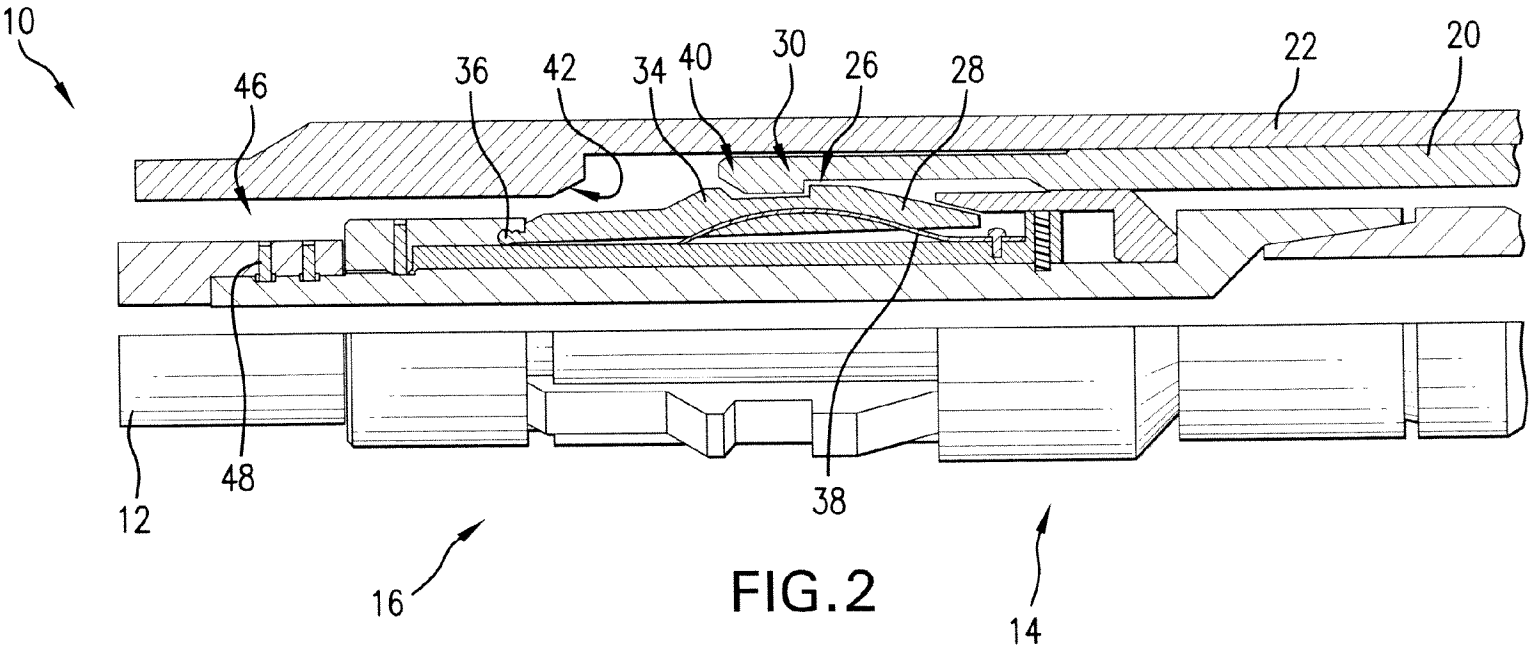
FIG. 2 is a three-quarter sectional view of the system of FIG. 1 disposed within a tubular string with a sleeve shifted by the tool to a first position.
Figure 3:
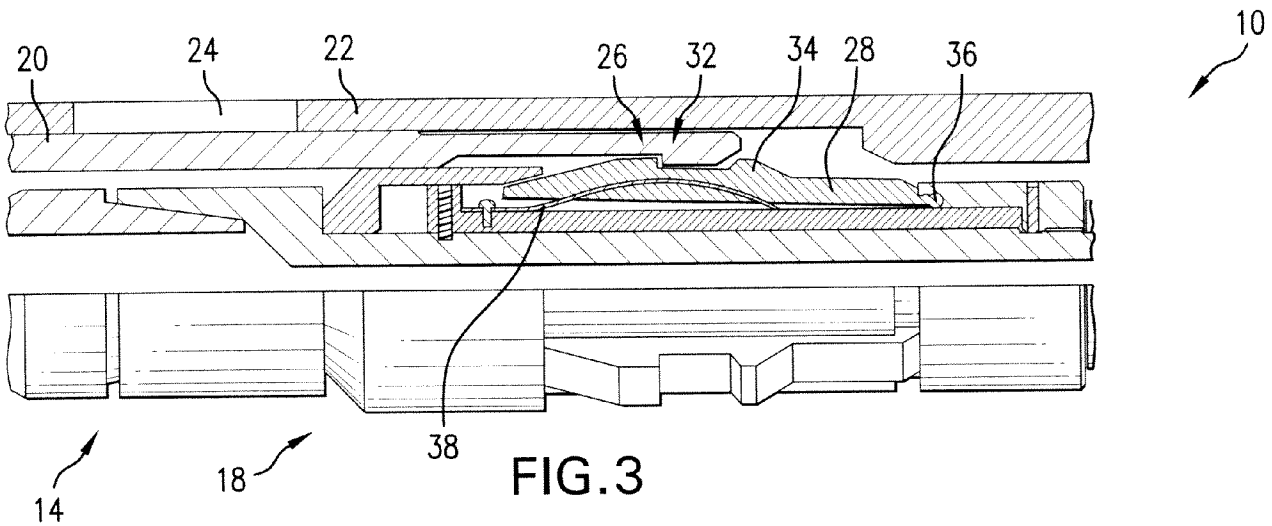
FIG. 3 is a three-quarter sectional view of the system of FIG. 2 with the sleeve shifted to a second position.

Referring now to the embodiment of FIGS. 1-3, the tool 14 includes an upper sub 16 and a lower sub 18 in order to shift sleeves, e.g., a sleeve 20. The sleeve 20 and other sleeves resembling the sleeve 20 are slidably housed in a tubular string 22, which is, e.g., a production string. The upper and lower subs 16 and 18 are essentially mirror images of each other and arranged for shifting sleeves in two opposite directions, in order to, for example, selectively open and close ports, e.g., frac ports, in the tubular string 22, such as a port 24 shown in FIG. 3. Accordingly, like-components of each sub 16 and 18 are assigned the same reference numeral and are structurally and functionally arranged as described herein (with the exception, as noted, that the subs 16 and 18 are arranged as mirror images of each other).

In the embodiment of FIGS. 1-3, for example, the upper and lower subs 16 and 18 are each arranged with a key 26 on a dog 28 for engaging with a corresponding engagement profile in the tubular string 22. As shown, multiple dogs each having their own key may be included circumferentially about each sub 16 and 18. Specifically in this embodiment, the upper sub 16 is arranged to engage with an engagement profile 30 of the sleeve 20. After engaging the keys 26 and 30 together, pulling out the service string 12 will cause the tool 14 to shift up the sleeve 20 (i.e., to the left with respect to the orientation of FIG. 2). Of course, the tool 14 and/or the sub 16 could be arranged to shift the sleeve 20 in another direction.

Similarly, the key 26 on the dog 28 of the lower sub 18 is arranged for engaging with a second engagement profile 32 of the sleeve 20 for shifting the sleeve 20 down (i.e., to the right with respect to the orientation of FIG. 3). The second engagement profile 32 is located at the opposite end of the sleeve 20 from the profile 30, and the two opposite ends of the sleeve 20 resemble, for example, mirror images of each other, similar to the upper and lower subs 16 and 18. That is, the engagement profile 30 faces substantially the opposite direction than the profile 32, which is similarly true of the keys 26 on the upper and lower subs 16 and 18, respectively. In this way, the key 26 of each of the upper and lower subs 16 and 18 is arranged to engage one of the profiles 30 or 32.

As shown in FIG. 3, the port 24 or a plurality of ports are locatable in the tubular string 22 proximate either end of the sleeve 20 for enabling movement of the sleeve 20 to selectively open the port or ports 24. In the embodiment of FIGS. 2-3, the port 24 is positioned proximate the end of the sleeve 20 that includes the profile 32. Thus, movement of the sleeve 20 toward the opposite end, e.g., up toward the profile 30 (e.g. to the left as shown), will cause the sleeve 20 to open the port 24 by sliding past the port 24. Similarly, moving the tool 14 down (e.g., to the right as shown) will cause the sleeve 20 to close the port 24. Seals (not shown) or the like can be included between the sleeve 20 and the tubular string 22 for sealing the port when it is closed. Is it to be noted again that the tool 14, sleeve 20, etc. could be arranged differently, e.g., oppositely, with the upper sub 16 arranged for shifting sleeves down and the lower sub 18 arranged for shifting sleeves up. Multiple sleeves resembling the sleeve 20 could be included along the length of tubular string 22, e.g., for enabling a plurality of locations to be fractured in a fracturing operation. The keys 26 and engagement profiles 30 and 32 are arranged substantially perpendicular to the axial movement direction for ensuring relative movement between the sleeve 20 and the tool 14 is fully restricted when complementary pairs of the profiles are engaged, although other arrangements are possible depending upon the direction of movement and the amount of interference desired between the engagement profiles and keys.

In addition to the key 26, each of the dogs 28 includes a disengagement element 34 for enabling the tool 14 to disengage from and move past the sleeve 20 in either direction of movement of the tool 14. Specifically, the element 34 resembles a double-sided ramp in the illustrated embodiment, although other structures are possible. The disengagement element 34 is used in conjunction with an ability of the dogs 28 to move or pivot radially inwardly. For example, in one embodiment the dogs 28 are each fixed at a pin 36 and pivotable radially inwardly against the force of a spring element 38, which urges the dogs 28 radially outward by default. Sloped surfaces of the element 34 thus act to move the dogs 28 radially inwardly when axially pulled or pressed against either of surfaces 40 and 42 of the sleeve 20 and the tubular string 22, respectively. When moved radially inwardly, the keys 26 of the dogs 28 are precluded from locking or engaging the tool 14 with either the sleeve 20 or the tubular string 22 and relative movement is accomplishable in either axial direction. For example, as in the embodiment of FIGS. 2-3, the element 34 will only disengage its corresponding dog 28 after the sleeve 20 has been shifted to a position at which the either the sleeve 20 or the element 34 is supported against the tubular string 22, such that a predetermined force can be overcome for pivoting the dog 28 inward and enabling relative movement between the tool 14 and the sleeve 20. Alternate embodiments are appreciable in view of the foregoing, such as radially inwardly facing keys on dogs that are movable radially outwardly for causing disengagement thereof.

Figure 4:
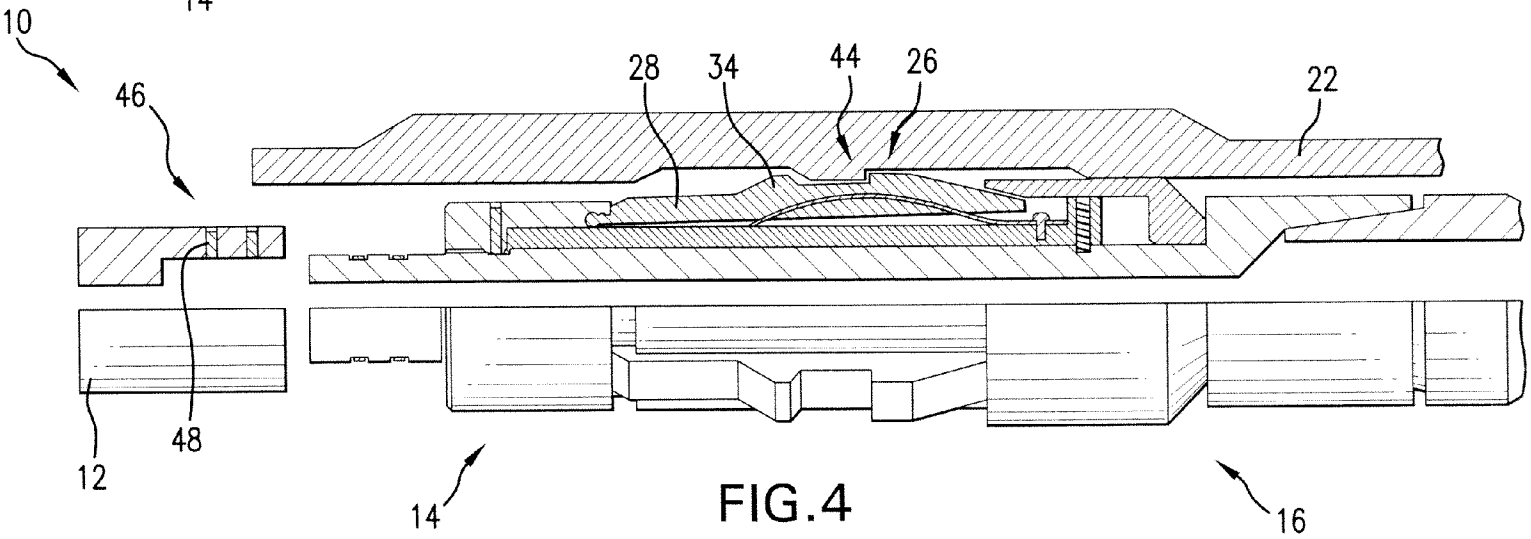
FIG. 4 is a three-quarter sectional view of the system of FIG. 1 illustrating the tool engaged with a locking profile of a tubular string and released from the service string.

As shown in FIG. 4, a locking profile 44 is also included along the tubular string 22. Unlike the profiles 30 and 32, the locking profile 44 is rigidly or non-movably affixed to (e.g., integrally formed with) the tubular string 22. The profile 44 resembles the profile 30 with the exception that the profile 44 is not formed on a slidable sleeve. Accordingly, as the profile 44 is not disposed on a slidable or moveable component, axial force on the tool 14 after engagement with the locking profile 44 will not cause the tool 14 to move. Without movement of the tool 14, the disengagement element 34 cannot encounter a corresponding surface to effect disengagement of the key 26. Alternatively stated, once the profile 30 of the tool 14 is engaged with the profile 44, the tool 14 is locked to the tubular string 22.

In order to pull out the service string 12 from the tubular, a releasable connection 46 is included connecting the tool 14 to the service string 12. In the illustrated embodiment, the releasable connection 46 is formed by shear screws 48, although other release members, e.g., shear rings, collet fingers, etc. could be substituted therefor. Advantageously, the tool 14 can be locked in the tubular string 22 and a force exerted thereon for releasing the releasable connection 46, e.g., shearing the shear screws 48, and pulling out the service string 12.

Again, although one embodiment is discussed and shown in detailed, e.g., the tool 14 of the system 10, one of ordinary skill will immediately appreciate that there are many other shifting tools known in the art. Further, one of ordinary skill would additionally appreciate that these other tools are adaptable for use with a locking profile, e.g. the profile 44, and a releasable connection, e.g., the connection 46, as described herein.

In one exemplary embodiment, the tool 14 and the tubular string 22 are run in together with all of the ports initially closed by their corresponding sleeves (e.g., the port 24 blocked by the sleeve 20). In this example, the tool 14 is initially located between the locking profile 44 and the bottom-most sleeve. By pulling out the service string 12, the upper sub 16 of the tool 14 will engage the bottom-most sleeve and pull it up, opening its corresponding port or ports. Fracturing fluid and/or proppant media is then pumpable through the port as part of a fracturing operation. The sleeve can then open each successive port by shifting the corresponding sleeves for enabling multiple locations to be sequentially fractured. After fracturing all locations, the tool 14 is run back in for engagement with the locking profile 44, closing all of the ports along the way and preparing the tubular string for receiving formation fluid through, for example, sand screens as opposed to the frac ports. After engagement with the locking profile 44, the service string 12 is tensioned, the connection 46 released, and the service string 12 pulled out. Since the tool 14 remains downhole, there is no risk of the tool 14 unintentionally opening any ports while it is pulled out. Of course, this is one example only, and other operations and arrangements are possible utilizing the invention as described herein.

Advantageously, by positioning the profile 44 downhole of all of the sleeves, ports, etc., that are shiftable or controllable by the tool 14, premature engagement with the locking profile 44 can be avoided. For example, the tool 14 could be run-in with the string 22 up-hole of the profile 44 and the operators would not further insert the service string 12 until the downhole operation, e.g., fracturing, has occurred and the sleeves are in their desired positions, e.g., closed. Moreover, placing the locking profile 44 downhole of the sleeves will ensure that the tool 14 does not block or other disturb the flow of formation or production fluids up through the string 22. Of course, other arrangements for the profile 44 are possible, depending upon the desired operation to be performed, particular structure of the tubular string or other components, etc.

Figure 5:
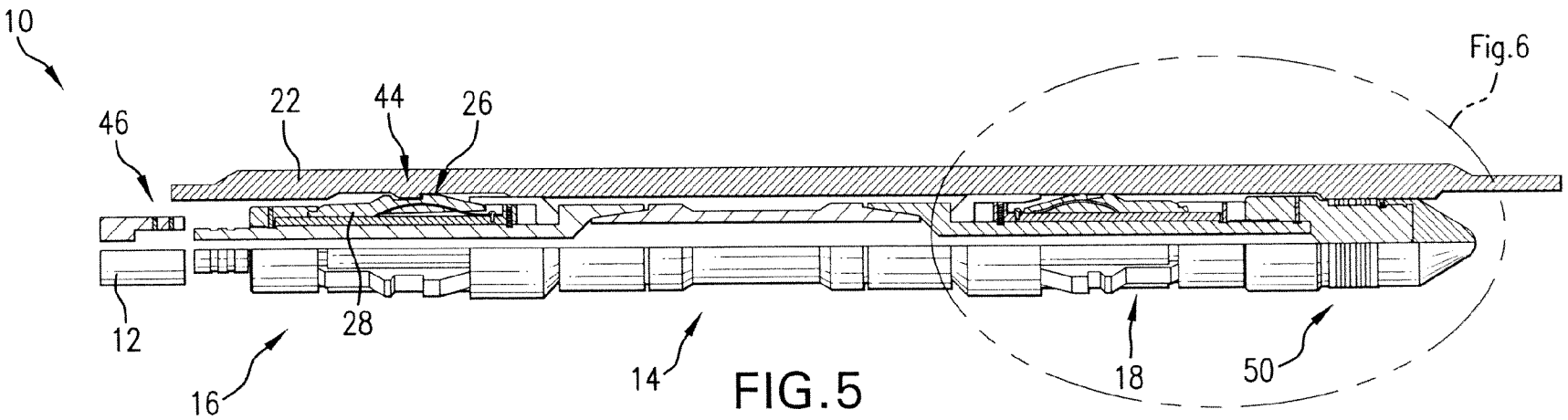
FIG. 5 is a three-quarter sectional view of a tool having an isolation assembly engaged with a locking profile of a tubular string.
Figure 6:
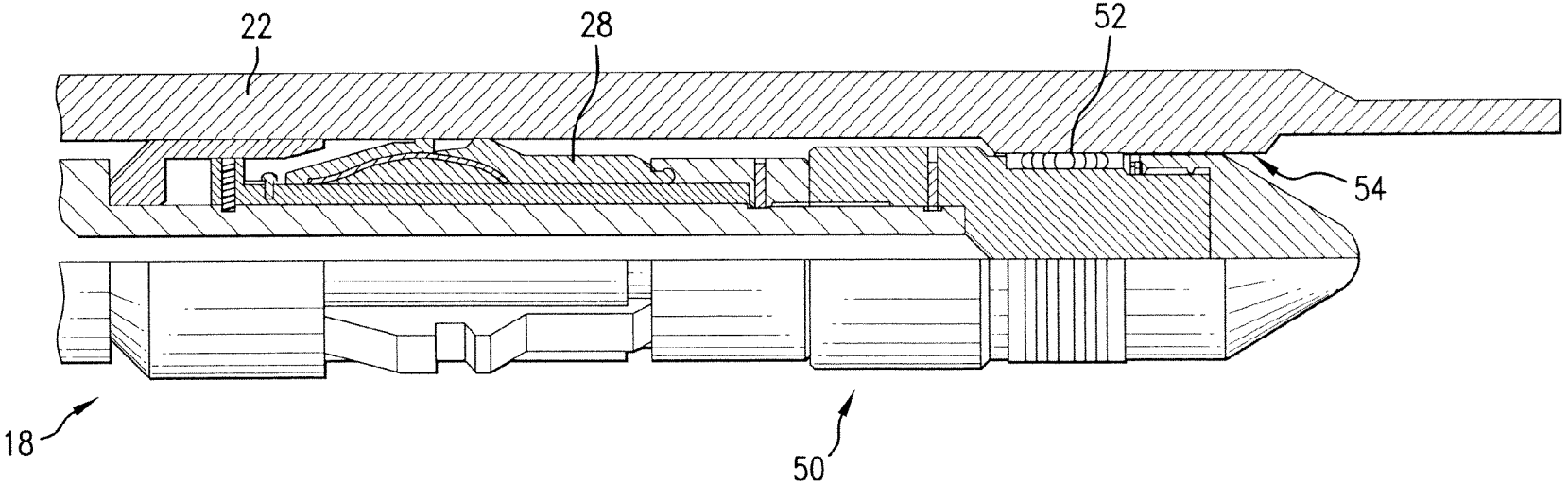
FIG. 6 is an enlarged view of the area encircled in FIG. 5.

In some embodiments, isolation may be desired in the tubular string 22. For example, the bottom sub 18 of the tool 14 in the embodiment of FIGS. 5 and 6 is equipped with an isolation assembly 50 for isolating the tubular string 22 on opposite sides of the isolation assembly 50 after the tool 14 is locked at the profile 44. The isolation assembly 50 could include a seal stack 52 or any other type of seal element(s) for sealingly engaging with the tubular string 22, e.g., at a seal bore 54. In this way, for example, fluid and pressure isolation is accomplishable between different zones along the length of the tubular string 22.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system for performing a downhole operation, comprising:

a tubular string having a locking profile non-movably located therewith;

at least one member movably mounted with the string and including an engagement profile; and a tool runnable with the string and having at least one sub with a key, the tool including an isolation assembly for providing a seal within the string the key including a recess selectively engagable and disengaable with the profile for enabling the tool to control movement of the member with respect to the string when engaged therewith, the recess also being selectively engagable with the locking profile for restricting relative movement between the string and the tool when engaged therewith, wherein the isolation assembly is only in sealed engagement with the string when the key is engaged with the locking profile.

2. A system for performing a downhole operation, comprising:

a tubular string having a locking profile non-movably located therewith;

at least one member movably mounted with the string and including an engagement profile wherein moving the member between a first position and a second position enables at least one port to be selectively opened or closed; and a tool runnable with the string and having at least one sub with a key, the tool being operatively arranged to move the member from the first position to the second position position when the key and the engagement profile are engaged, the key including a recess selectively engagable and disengagable with the engagement profile for enabling the tool to control movement of the member with respect to the string when engaged therewith, the recess also being selectively engagable with the locking profile for restricting relative movement between the string and the tool when engaged therewith, wherein the tool includes a disengagement element for disengaging the key from the engagement profile when the member is moved to the second position.

3. A method of performing a downhole operation comprising:

running in a tool with a string, the string having at least one member movably mounted with the string, the member having an engagement profile;

engaging a recess formed in a key of the tool with the engagement profile of the member;

moving the member with a service string connected to the tool;

disengaging the key from the engagement profile;

engaging the recess in the key with a locking profile non-movably secured to the string for restricting relative movement of the tool with respect to the string; and detaching the tool from the service string after the key is engaged with the locking profile.

4. The method of claim 3, wherein detaching the tool from the service string comprises tensioning the service string to cause release of at least one release element.

5. The method of claim 4, wherein moving the member enables at least one port to be selectively opened or closed.

6. The method of claim 3, wherein positioning the tool while engaging the key with the locking profile also results in an isolation assembly of the tool to sealing engage with the string for providing isolation therein.

* * * * *